United States Patent [19]

Preston, III

[11] Patent Number: 4,524,299

[45] Date of Patent: Jun. 18, 1985

[54] FLUORESCENT SUNLAMP HAVING CONTROLLED ULTRAVIOLET OUTPUT

[75] Inventor: George V. Preston, III, Plainsboro, N.J.

[73] Assignee: North American Philips Corporation, New York, N.Y.

[21] Appl. No.: 366,890

[22] Filed: Apr. 8, 1982

[51] Int. Cl.[3] ..... H01J 61/38; H01J 61/40

[52] U.S. Cl. ..... 313/487; 313/489; 313/112

[58] Field of Search ..... 313/487, 489, 486, 485, 313/112, 44, 47

[56] References Cited

U.S. PATENT DOCUMENTS

| | | | |
|---|---|---|---|
| 2,447,210 | 8/1948 | Roberts | 313/486 |
| 2,563,900 | 8/1951 | Wollentin et al. | 313/486 |
| 2,563,901 | 8/1951 | Nagy et al. | 313/486 |
| 3,310,418 | 3/1967 | Friedman et al. | 428/330 |
| 3,715,612 | 2/1973 | Someya et al. | 313/486 |
| 3,764,840 | 10/1973 | Shiraishi | 313/487 |
| 3,890,522 | 6/1975 | Klein | 313/485 |
| 4,069,441 | 1/1978 | Wanmaker et al. | 313/487 |
| 4,079,288 | 3/1978 | Maloney et al. | 313/493 |
| 4,199,708 | 4/1980 | Lauwerijssen et al. | 313/612 X |

FOREIGN PATENT DOCUMENTS

| | | | |
|---|---|---|---|
| 2059147 | 4/1981 | United Kingdom | 252/301.4 R |

*Primary Examiner*—David K. Moore
*Assistant Examiner*—K. Wieder

[57] ABSTRACT

An inert coating of calcium pyrophosphate in finely-divided form is provided on the inner surface of the envelope of a fluorescent sunlamp underneath the phosphor layer to reduce the emission of undesirable short-wavelength ultraviolet radiation (190 nm to 260 nm region). The relative densities of the phosphor layer and undercoating of calcium pyrophosphate are so correlated that the ratio of short-wavelength ultraviolet radiation to erythemal radiation is maintained below a prescribed limit. The particles of calcium pyrophosphate are also larger than about 1 micron and are thus adapted to selectively absorb the undesirable short-wavelength radiations and provide an integral UV-filtering means for the sunlamp.

9 Claims, 3 Drawing Figures

FLUORESCENT SUNLAMP HAVING CONTROLLED ULTRAVIOLET OUTPUT

CROSS-REFERENCE TO RELATED APPLICATION

The subject matter of this application is related to and constitutes an improvement over that disclosed and claimed in pending application Ser. No. 291,743 filed Aug. 11, 1981 by G. V. Preston III et al., which application is assigned to the same assignee as this application.

BACKGROUND OF THE INVENTION

This invention generally relates to electric discharge lamps and has particular reference to a fluorescent sunlamp which produces controlled amounts of ultraviolet radiation.

Low-pressure type discharge lamps which contain a phosphor that emits radiations in the erythemal portion of the spectrum (the wavelength region of from about 260–320 nm.) are well known in the art. A fluorescent lamp which generates both germicidal and erythemal rays in a predetermined ratio is disclosed in U.S. Pat. No. 3,715,612 issued Feb. 6, 1973 to A. Someya et al. In U.S. Pat. No. 3,764,840 issued Oct. 9, 1973 to H. Shiraishi there is disclosed a fluorescent lamp that produces both visible light and erythemal rays at a ratio which is roughly the same as that in natural daylight. This is achieved by combining two phosphor materials with a bulb that is composed of a soda-lime glass which does not transmit radiations having a wavelength less than 295 nm.

Phosphor materials which efficiently emit ultraviolet radiations in the erythemal region are also well known in the art. U.S. Pat. No. 2,563,900 to Wollentin et al. and U.S. Pat. No. 2,563,901 to Nagy et al. disclose a thallium-activated calcium zinc orthophosphate phosphor and a thallium-activated calcium magnesium orthophosphate phosphor, respectively, which have enhanced outputs of erythemal radiation compared to the thallium-activated calcium orthophosphate phosphor employed in the prior art.

The use of a small amount of finely-divided calcium pyrophosphate ($Ca_2P_2O_7$) as an additive in a fluorescent coating to improve the adherence of the phosphor particles to the glass bulb of a general lighting type fluorescent lamp and also reflect radiations in the 200 to 700 nm region is disclosed in U.S. Pat. No. 3,310,418 issued Mar. 21, 1967 to A. I. Friedman et al. As indicated in columns 1 and 2 of this patent, optimum results were obtained by using calcium pyrophosphate particles of very small particles size (less than about 1 micron in diameter) and by utilizing from 5 to 10 grams of such material in a coating suspension containing 1,000 grams of a halophosphate type phosphor. The calcium pyrophosphate additive accordingly comprised from about 0.5 to 1% by weight of the phosphor content and, since the lamp is designed for use as a general lighting device rather than a sunlamp, it contains only phosphors that emit radiations in the visible region rather than the ultraviolet region of the spectrum.

Sumlamps are rated in terms of E-Viton units. An E-Viton is a quantitative unit of the amount of erythemal ultraviolet radiation which is transmitted by the lamp and is a measure of the effectiveness of the various wavelengths of ultraviolet rays in producing skin reddening. An E-Viton corresponds to the quantity of radiant energy which produces as much reddening of the skin as 10 microwatts of energy at a wavelength of 296.7 nm. Fluroescent lamps of the 40 watt T12 size typically have an output in the range of from around 175,000 to 225,000 E-Vitons.

The phosphors used in fluorescent sunlamps produce ultraviolet radiations having wavelengths which range from about 260 nm to 380 nm. Shorter wavelength ultraviolet radiations generated by the arc discharge and emitted by the lamp (190 nm to 260 nm) are undesirable since they produce very little, if any, tanning of the skin and are suspect from the standpoint of skin cancer. In contrast, the longer wavelength ultraviolet radiations (260 nm to 320 nm) are very effective in producing skin tanning without burning or causing vivid reddening of the skin if exposure times are carefully controlled. As a consumer protective safeguard, the U.S. Government recently established a Federal Performance Standard for sunlamp products which is specified in 21 C.F.R. 1040.20 and requires that the ratio of short-wave emission and longwave emission in the ultraviolet region for such lamps be kept below a certain value. Specifically, the Federal Standard requires that the ratio of short UV radiation (190–260 nm range) to long UV radiation (260–320 nm range) be less than 0.003.

Lamp tests have demonstrated that the aforementioned performance standard can be met by increasing the density of the phosphor coating of a conventional fluorescent sunlamp through the use of higher powder weights (that is, thicker phosphor coatings). However, it was found that small changes in the coating density drastically affect the output of the sunlamp within the long wavelength region (260–320 nm range) and that the use of larger amounts of phosphor increased the E-Viton output to a value above that desired for safe and effective skin tanning. In addition, the use of heavier phosphor coatings to reduce the amount of short UV radiation that is transmitted by the lamp inherently increases the amount of phosphor required per lamp and adds to the manufacturing cost.

SUMMARY OF THE INVENTION

It has been discovered that the Government-mandated safety standard regarding the ultraviolet output of fluorescent sunlamps can be met in a convenient and economical manner, without exceeding the established E-Viton output levels for such lamps, by coating the inner surface of the lamp envelope with a layer of calcium pyrophosphate (in particle form) before the phosphor suspension or paint is deposited on such surface so that the phosphor particles in the finished lamp comprise a separate layer of material that covers the calcium pyrophosphate coating. Calcium pyrophosphate is a nonluminescent material that is inert with respect to the lamp interior and, in finely-divided form, has the property of being substantially opaque to short-wave UV but substantially transparent to long-wave UV in the 260–320 nm region. The undercoating of finely-divided calcium pyrophosphate thus serves as an integral UV-filtering means for the sunlamp which selectively blocks the undesirable short-wave UV radiations but does not drastically reduce the desired long UV output of the lamp generated by the layer of phosphor. By properly correlating the thickness or density of the phosphor layer with that of the calcium pyrophosphate undercoat, the E-Viton and short-wave UV output of fluorescent sunlamps can be accurately controlled and maintained within the required limits. Since the UV-emitting phosphor is not diluted with any additives and is directly exposed to the 254 nm radiations generated by arc discharge, it is excited by such radiations in a very efficient manner. The resulting increase in the long UV energy emitted by the phosphor permits the amount of phosphor per lamp to be reduced without decreasing the E-Viton output of the sunlamp below that required for satisfactory skin tanning. This is an important advantage in the case of thallium-activated calcium orthophosphate phosphor since it is both toxic and expensive. Calcium pyrophosphate, in contrast, is non-toxic and inexpensive.

The present invention accordingly permits the E-Viton output of a fluorescent sunlamp to be maintained at a commercially acceptable level and within the Federal Performance Standard with respect to short UV emission by combining a layer of selected erythemal-emitting phosphor with a relatively thick undercoating of calcium pyrophosphate particles that are deposited on the inner surface of the lamp envelope and from a selective UV filter of inert material which is covered by the phosphor layer and controls the UV output of the sunlamp.

BRIEF DESCRIPTION OF THE DRAWING

A better understanding of the invention will be obtained from the exemplary embodiment shown in the accompanying drawing, wherein.

DESCRIPTION OF THE PREFERRED EMBODIMENT

While the present invention can be employed to control the ultraviolet output of various kinds of radiation-generating devices, it is particularly adapted for use in conjunction with fluorescent sunlamps and it has accordingly been so illustrated and will be so described.

Figure 1:
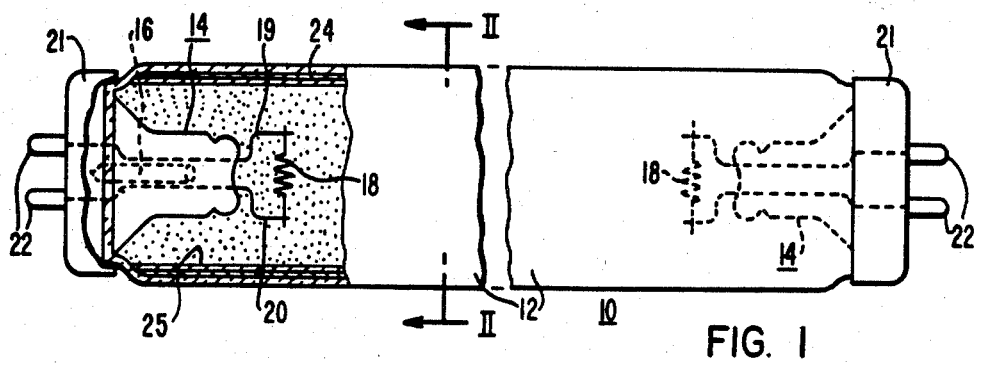
FIG. 1 is a side elevational view, partly in section, of a tubular fluorescent sunlamp which embodies the dual-coating concept of the invention.
Figure 2:
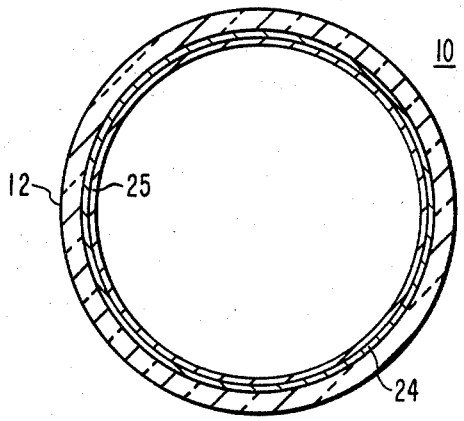
FIG. 2 is an enlarged cross-sectional view through the lamp along line II—II of FIG. 1.

A fluorescent sunlamp 10 which is representative of the type of low-pressure discharge device or ultraviolet radiation source which would embody the present invention is shown in FIGS. 1 and 2. As will be noted, the sunlamp 10 comprises the usual tubular glass envelope 12 that is sealed at each end by a glass stem 14—one of which has a tubulation 16 through which the envelope is evacuated and dosed with a small amount of mercury and a suitable fill gas in the usual manner. The mercury vapor and fill gas within the sealed envelope constitute an ionizable medium which sustains an electric discharge that passes between a pair of thermionic electrodes 18 when the lamp is energized. The electrodes 18 are secured to the respective stems 14 by lead wires 19 and 20 and the sealed ends of the envelope 12 are fitted with suitable base members 21 having the usual pair of pin terminals 22 that are connected to the lead wires 19, 20 of the associated stems.

In accordance with the invention, the inner surface of the envelope 12 is provided with a coating 24 of finely-divided calcium pyrophosphate that is covered by a layer 25 of a UV-emitting phosphor. As shown in FIGS. 1 and 2, the dual coatings 24, 25 are of substantially uniform thickness and extend around the entire circumference of the envelope 12 and along its entire length.

The phosphor material in the top coating 25 is of a type that is excited by the ultraviolet radiations (mainly 253.7 nm) generated by the low-pressure mercury-vapor discharge and has its peak emission in the long ultraviolet (erythemal) region of the spectrum. Phosphors which emit such radiations in response to the ultraviolet radiations produced by the discharge within the fluorescent sunlamp 10 are well known in the art. A preferred phosphor which has its peak emission in the erythemal portion of the spectrum (260–320 nm) is thallium-activated calcium zinc orthophosphate. The chemical formula for this phosphor is $(Ca,Zn)_3(PO_4)_2$:Tl. Other suitable sunlamp phosphors which have similar emission spectra and can be used are barium zinc silicate activated by lead ($BaZn_2Si_2O_7$:Pb), calcium magnesium orthophosphate activated by thallium chemically identified as $(Ca,Mg)_3(PO_4)_2$:Tl, and thallium-activated calcium orthophosphate whose chemical formula is $Ca_3(PO_4)_2$:Tl.

The envelope 12 is composed of soda-lime silica type glass which transmits the ultraviolet radiations produced by the phosphor and thus permits the lamp 10 to be used as a skin-tanning lamp. A suitable glass of this type is Corning Code No. 9821 glass. A typical batch formula for this particular glass is as follows: 450 parts (58.8% by weight) of sand or $SiO_2$, 100 parts or 13.1% by weight of dolomite ($CaCO_3$ with minor amounts of Mg as an impurity), 8 parts of hydrated alumina (1% by weight) which provides $Al_2O_3$ in the finished glass, 160 parts (20.8% by weight) of soda ash or $NaCO_3$, 35 parts (4.6% by weight) of nitre or $KNO_3$, 8 parts (1% by weight) of hydrated $K_2CO_3$, 2 parts (0.26% by weight) of litharge or PbO, and 3 parts (0.39% by weight) of $Sb_2O_3$.

Figure 3:
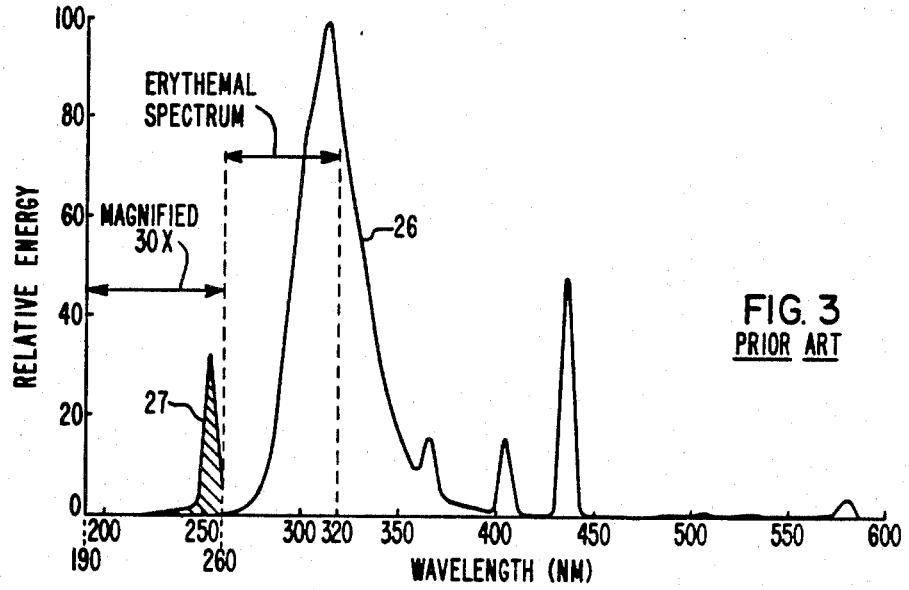
FIG. 3 PRIOR ART
FIG. 3 is the energy distribution curve of a conventional 40-watt T12 fluorescent sunlamp that has an envelope which is coated with thallium-activated calcium zinc orthophosphate phosphor but does not include the undercoating of inert calcium pyrophosphate pursuant to the present invention.

The spectral distribution of the output of a conventional 40-watt T12 fluorescent sunlamp having an envelope which is composed of the aforementioned Corning Code No. 9821 glass and is coated with thallium-activated calcium zinc orthophosphate phosphor but does not include the undercoat of calcium pyrophosphate pursuant to the present invention is shown in FIG. 3 and represented by curve 26. As will be noted, the peak output of the lamp is in the long wavelength ultraviolet region (at about 313 mm) so that the major portion of its output is within the erythemal spectrum (the region of approximately 260–320 nm indicated in FIG. 3). Unfortunately, such conventional sunlamps also emit a small but very undesirable amount of energy in the short wavelength ultraviolet region (from about 190–260 nm) and it is these shorter-wavelength radiations from the mercury arc which must be diminished or eliminated if the aforementioned Government-mandated performance standard for sunlamp products is to be complied with. The short wavelength radiation generated by the mercury arc peaks at around 254 nm, is indicated by the portion 27 of the curve in the magnified portion of the lamp output spectrum shown in FIG. 3. Conventional fluorescent sunlamps having such an output typically have a phosphor coating which is quite thin and have a powder coating density of 0.002 gram of phosphor per square centimeter of bulb surface. The violet and blue emissions at 405 nm and 440 nm in the visible portion of the spectrum are also generated by the mercury-vapor discharge itself rather than the phosphor.

In accordance with the present invention, the aforementioned undesirable short-wavelength ultraviolet radiations emitted by fluorescent sunlamps are reduced to acceptable levels without detracting from the E-Viton or desired erythemal output of the lamp by depositing a coating 24 of calcium pyrophosphate ($Ca_2P_2O_7$) particles on the inner surface of the lamp envelope 24 before it is coated with phosphor. Calcium pyrophosphate is nonluminescent and inert with respect to the lamp interior. It is also one of the materials that is used in the manufacture of halophosphate type phosphors and, as such, is thus readily available in the fluorescent lamp industry and quite inexpensive. Calcium pyrophosphate particles have properties which are unique and make them especially useful for this particular application insofar as they are substantially opaque to the undesirable short-wave UV but are substantially transparent to long-wave UV in the 260–320 nm region. The undercoating 24 of calcium pyrophosphate particles thus functions as an integral filter or screen with regard to the undesirable short-wave UV (190–260 nm region) without seriously attenuating the desired 260–320 nm UV radiation emitted by the phosphor layer 24 nor drastically reducing the E-Viton output of the sunlamp 10.

In addition to blocking the undesirable shortwave UV radiations, the undercoating 24 of calcium purophosphate provides an additional advantage in that it places the phosphor layer 25 close to the arc discharge and in direct radiation-receptive relationship with the 254 nm photons that are produced by the arc and excite the phosphor. The resulting increase in the output of the phosphor layer 25 and of the lamp 10 permits the amount of phosphor per lamp to be reduced by a proportionate amount while maintaning an E-Viton output which matches that of a conventional sunlamp of the same size and rating.

The accepted target output of a T12 fluorescent sunlamp which has an envelope 1.5 inches (38 mm) in diameter, an overall length of approximately 4 feet (122 cms), and a nominal rating of 40 watts is approximately 200,000 E-Vitons at 0 hours burning and the commercially acceptable range for the erythemal output of this type sunlamp is from approximately 150,000 to 205,000 E-Vitons.

In order to maintain the E-Viton output of the improved sunlamp 10 at commercially acceptable levels, the densities of the phosphor layer 25 and calcium pyrophosphate coating 24 must be properly correlated. As a specific example, an output of 218,000 E-Vitons at zero hours burning was obtained with a 40-watt T12 fluorescent sunlamp having a phosphor coating density of about 0.0014 gram per square centimeter of bulb surface (about 1.96 grams per bulb) and a coating density of about 0.0014 gram per square centimeter of bulb surface (about 1.89 grams per bulb) for the calcium pyrophosphate undercoat. The two coatings were thus of roughly the same density and provided a substantial reduction in the amount of phosphor required per lamp. The phosphor was the preferred thallium-activated calcium orthophosphate and the ratio of shortwave to long-wave UV radiation was approximately 0.00146 with a standard deviation of 0.00025.

The permissible range for the phosphor coating density is from about 0.0013 gram to 0.0015 gram per $cm^2$ of bulb surface and the permissible range for the calcium pyrophosphate coating density is from about 0.0013 gram to 0.0015 gram per $cm^2$ of bulb surface.

The particle size of the calcium pyrophosphate used to form the inert undercoat 24 is rather important insofar as it determines the effectiveness of the undercoat in blocking the undesirable short ultraviolet radiations and transmitting the desirable long ultraviolet radiations. While an average particle size of from about 8 to 17 microns is preferred, particles as small as about 1 micron and as large as about 40 microns can be used.

The calcium pyrophosphate and phosphor coatings are preferably formed by suspending the particles of the respective materials in suitable aqueous suspensions that contain well-known constituents and form paints of the proper viscosity. After the paints are thoroughly mixed they are deposited on the inner surface of the lamp envelope in separate coating operations, the envelopes in each case being dried and baked in the usual manner at a temperature of around 500°–600° C. for several minutes to vaporize the binder. The uniformly dual-coated envelopes are then made into fluorescent sunlamps in the customary manner by sealing the glass stems and the thermionic electrodes into the ends of the envelopes, evacuating and filling the envelopes with a starting gas (such as argon at a pressure of several Torr) and a small quantity of mercury and then tipping off the tubulated stem.

While the details of the coating weights, etc. have been given in terms of a fluorescent sunlamp of the 40-watt T12 size, it will be appreciated to those skilled in the art that the invention is not limited to this particular lamp type but can be advantageously employed in sunlamps of different sizes and ratings, for example 20 watt lamps having tubular envelopes of shorter length.

I claim:

1. A sunlamp of the low-pressure electric discharge type comprising;

a sealed envelope that is composed of glass which transmits radiation in the ultraviolet region of the spectrum and contains a pair of electrodes and an ionizable discharge-sustaining medium that generate ultraviolet radiations of various wavelengths, including undesirable ultraviolet radiations having wavelengths in the range from about 190 nm to about 260 nm and which are shorter than erythemal radiations, when the sunlamp is energized, phosphor material within said envelope which converts discharge-generated ultraviolet radiations into erythemal radiations having wavelengths in the range from about 260 nm to about 320 nm, and means for limiting the amount of said undesirable shorter-wavelength ultraviolet radiations that is emitted by the sunlamp to about 0.003 of the erythemal radiations, comprising a non-luminescent coating of finely-divided calcium pyrophosphate on the inner surface of said envelope and having particle sizes in the range from about 1 micron to about 40 microns, said phosphor material being disposed in a separate layer that overlies the calcium pyrophosphate coating and thereby places the phosphor material in close proximity to the electric discharge and in direct radiation-receptive relationship with the phosphor-exciting ultraviolet radiations generated by the discharge, said non-luminescent coating of calcium pyrophosphate being adapted to selectively absorb the undesirable short-wavelength ultraviolet radiations and thereby constituting an integral ultraviolet-filtering means for the sunlamp.

2. The sunlamp of claim 1 wherein;

said ionizable discharge-sustaining medium comprises a quantity of mercury and a fill gas.

3. The sunlamp of claim 2 wherein the layer of phosphor material and underlying coating of finely-divided calcium pyrophosphate are both of substantially uniform thickness and extend over substantially the entire inner surface of the envelope.

4. The sunlamp of claim 3 wherein the phosphor material comprises a phosphor from the group consisting of thallium-activated calcium zinc orthophosphate, lead-activated barium zinc silicate, thallium-activated calcium orthophosphate and thallium-activated calcium magnesium orthophosphate.

5. The sunlamp of claim 4 wherein the correlation of the relative amounts of the calcium pyrophosphate and phosphor in the filter coating and phosphor layer, respectively, is such that the ratio of the undesirable shorter-wavelength ultraviolet radiations to the erythemal ultraviolet radiations emitted byy the sunlamp is less than about 0.003.

6. The sunlamp of claim 1 wherein;

said phosphor comprises calcium zinc orthophosphate activated by thallium, the density of the phosphor layer, expressed in terms of the weight of phosphor per square centimeter of envelope surface, ranges from about 0.0013 gram per square centimeter to about 0.0015 gram per square centimeter, and the density of the calcium pyrophosphate filter coating, expressed in terms of the weight of the coating material per square centimeter of envelope surface, ranges from about 0.0013 gram per square centimeter to about 0.0015 gram per square centimeter.

7. The sunlamp of claim 6 wherein the envelope is composed of soda-lime silicate glass and is of tubular configuration.

8. The sunlamp of claim 6 wherein;

the finely-divided calcium pyrophosphate which comprises the filter coating has an average particle size of from about 8 to 17 microns, the density of the filter coating is approximately 0.0014 gram per square centimeter of envelope surface, and the density of the phosphor layer is approximately 0.0014 gram per square centimeter of envelope surface.

9. The sunlamp of claim 8 wherein;

said sunlamp has a nominal rating of 40 watts, and the densities of said filter coating and phosphor layer are so correlated that the sunlamp has an output of from about 150,000 to about 250,000 E-Vitons at zero hours burning.

* * * * *